US007314049B2

(12) United States Patent
Draghetti et al.

(10) Patent No.: US 7,314,049 B2
(45) Date of Patent: Jan. 1, 2008

(54) UNIT FOR TRANSFERRING CIGARETTE STICKS FROM A CIGARETTE MAKER TO A FILTER TIP ATTACHMENT

(75) Inventors: Fiorenzo Draghetti, Medicina (IT); Gian Luigi Gherardi, Medicina (IT)

(73) Assignee: G.D. S.p.A., Bologna (IT)

( * ) Notice: Subject to any disclaimer, the term of this patent is extended or adjusted under 35 U.S.C. 154(b) by 556 days.

(21) Appl. No.: 10/701,624

(22) Filed: Nov. 6, 2003

(65) Prior Publication Data

US 2004/0099278 A1 May 27, 2004

(30) Foreign Application Priority Data

Nov. 25, 2002 (IT) ..... B02002A0742

(51) Int. Cl.
*A24C 5/32* (2006.01)

(52) U.S. Cl. ..... 131/282; 131/280; 198/457.01; 198/457.02; 198/457.05; 24/455; 24/456

(58) Field of Classification Search ..... 131/280, 131/282; 198/457.01, 457.02, 457.05; 24/455, 24/456

See application file for complete search history.

(56) References Cited

U.S. PATENT DOCUMENTS 3,343,646 A 9/1967 Rowlands
3,791,507 A 2/1974 Kaeding
3,815,612 A 6/1974 Molins
3,985,144 A * 10/1976 Payne ..... 131/92
4,418,705 A 12/1983 Seragnoli
4,550,821 A * 11/1985 Horie et al. ..... 198/416
4,886,077 A 12/1989 Hinzmann
5,908,030 A * 6/1999 Coi et al. ..... 131/94

FOREIGN PATENT DOCUMENTS

| | | |
|---|---|---|
| EP | 0682881 | 11/1995 |
| EP | 0966890 | 12/1999 |
| FR | 1537029 | 8/1968 |
| GB | 2034577 | 6/1980 |
| IT | 1282484 | 3/1998 |

* cited by examiner

*Primary Examiner*—Steven P. Griffin
*Assistant Examiner*—Dennis R. Cordray
(74) *Attorney, Agent, or Firm*—Timothy J. Klima

(57) ABSTRACT

Cigarette sticks are transferred from a cigarette maker to a filter tip attachment by a unit that includes a conveying roller made to rotate in a first feed direction and furnished with channels aligned on a second direction transverse to the first direction. Each channel accommodates a single stick, directed onto the conveying roller by way of an impeller device, and presents two longitudinal areas designed to make contact progressively with corresponding longitudinal areas of the stick as it advances into the channel, the effect being to create a chamber between the stick and the part of the channel lying between the two longitudinal areas of contact, which is connected to a source of negative pressure.

16 Claims, 5 Drawing Sheets

UNIT FOR TRANSFERRING CIGARETTE STICKS FROM A CIGARETTE MAKER TO A FILTER TIP ATTACHMENT

This application claims priority to Application No. BO2002A000742, filed in ITALY on Nov. 25, 2002.

BACKGROUND OF THE INVENTION

The present invention relates to a unit for transferring cigarette sticks from a cigarette maker to a filter tip attachment.

The term "cigarette maker" describes a machine by which at least one continuous cigarette rod is fed at a substantially steady rate into a filter tip attachment, advancing along its own axis.

Passing through the outfeed of the cigarette maker, the continuous cigarette rod encounters a cutter head by which it is divided up into sticks normally of "double" length, that is to say, sticks measuring twice the length of a stick that will be joined ultimately with a respective filter tip to create a standard filter cigarette.

After the cutting step, the cigarette sticks continue to advance axially, pushed forward by the continuous rod behind, to the point of reaching a transfer position where each one is engaged by transfer mechanisms operating between the outfeed stage of the cigarette maker and an infeed device of the filter tip attachment. The infeed device in question takes the form of a roller rotatable about an axis parallel to that of the cigarette rod and furnished with a succession of aspirating seats or channels around the periphery, extending parallel to the rod and capable of movement in a direction transverse to their own axes and to the axial feed direction followed by the rod.

Conventional transfer mechanisms consist in an impeller type device comprising one or more rollers of which the function is to distance the sticks one from the next and guide each one into a relative channel of the infeed roller.

It will be clear that when entering the relative channels of the transfer mechanism, the sticks must decelerate to zero linear velocity in the axial direction and accelerate to the angular velocity of the roller in the transverse direction.

The single sticks are slowed to a halt by suction means incorporated into each of the channels.

Such means comprise a plurality of holes arranged along the bottom of each channel and connected to a source of negative pressure.

Sliding into the respective channel and engaging the suction holes one by one, the stick is made to advance progressively slower in the axial direction while being diverted in the transverse direction at the angular velocity of the roller.

The aspirating channels present a splayed profile at the entry end, thereby facilitating the passage of a relative stick onto the bottom of the channel, with which it makes contact along a straight line generator.

It will be evident that as the cigarette stick is taken up by the respective channel, the portions of the cylindrical surface of the stick exposed to the aspirating force are limited to the areas engaging the mouths of the suction holes.

The holes are typically three or four in number, each approximately 4 mm in diameter, and given the high axial velocity at which the cigarette sticks are caused to advance in filter tip attachments of recent design, it is essential that notably high values of negative pressure are generated in order to ensure that the sticks are retained swiftly and securely, especially at the moment of entering the channel, and apply a similarly swift and effective braking action to the stick as it advances along the channel. If not, the speed of entry on reaching the bottom of the channel will be likely to damage the stick and/or cause the tobacco filler to shed from the ends.

Also, because of the way the aspirating channels in question are fashioned currently, considerable pressure losses occur along the entire length of the channel and around the suction holes.

To overcome such problems, the prior art embraces the solution of using high power suction equipment in conjunction with pneumatic circuits that are rendered notably complex and costly as a result of being specified with ultra high strength pipelines and seals, the effect of which being to generate high electrical power consumption and high noise levels in the pneumatic circuits as the sticks enter the relative channels.

The object of the present invention is to provide a unit for transferring cigarette sticks from a cigarette maker to a filter tip attachment such as will be unaffected by the drawbacks mentioned above in referring to the prior art.

SUMMARY OF THE INVENTION

The stated object is realized according to the invention in a unit for transferring cigarette sticks from a cigarette maker to a filter tip attachment, comprising conveyor means capable of movement in a first feed direction and presenting channels designed each to accommodate a respective stick, extending in a second direction and made to advance in the first direction, passing through an entry station where a relative stick is admitted; also transfer means facing the entry station, by which the sticks are advanced along the second direction into the channels. In the unit disclosed, each channel presents at least two longitudinal areas of progressive contact with corresponding longitudinal areas of the stick, serving to create a chamber between the stick and the portion of the channel compassed between the longitudinal areas of progressive contact. The chamber is connected by way of first connection means to suction means.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
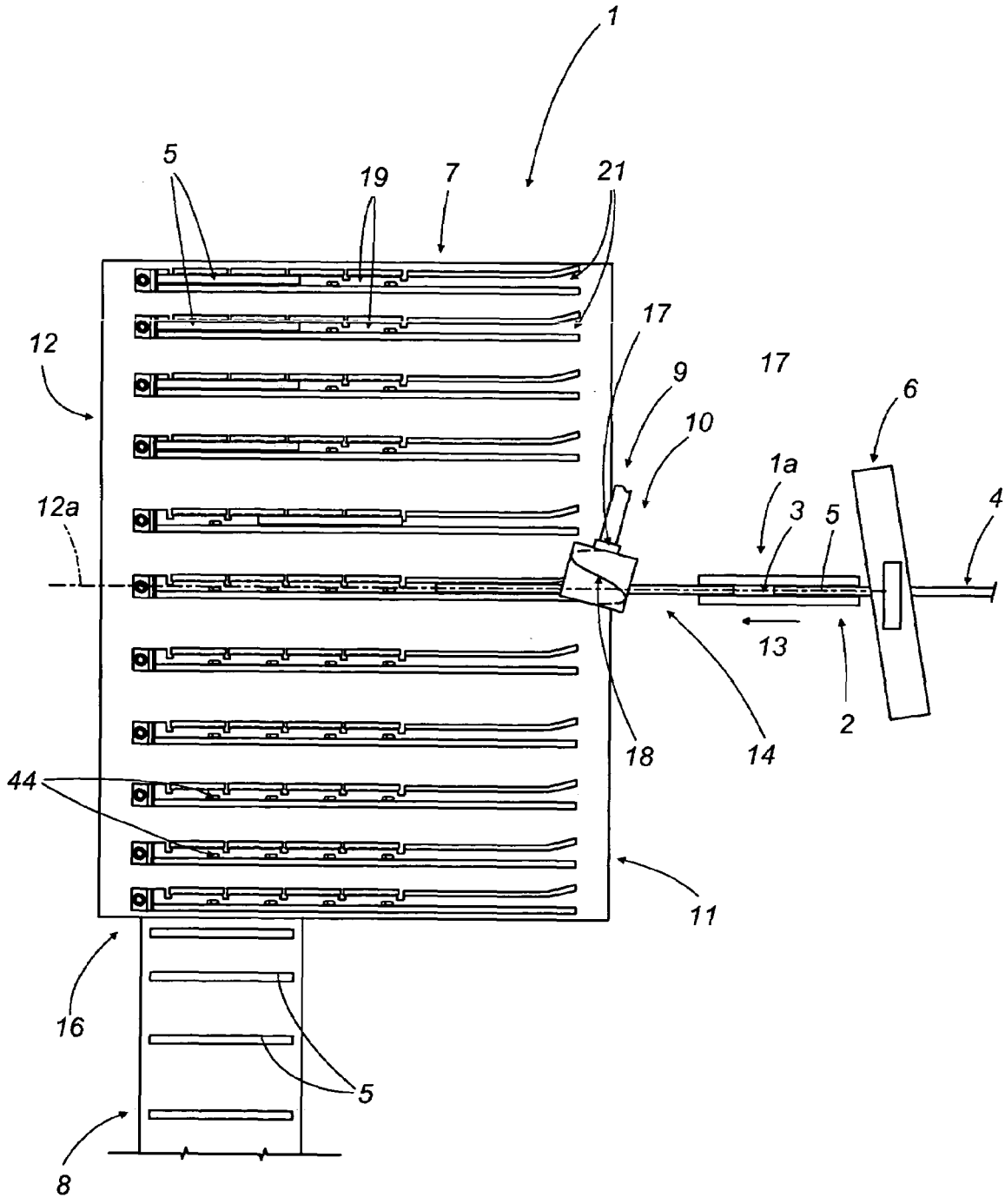
FIG. 1 shows a first embodiment of a transfer unit according to the present invention, viewed in plan.
Figure 2:
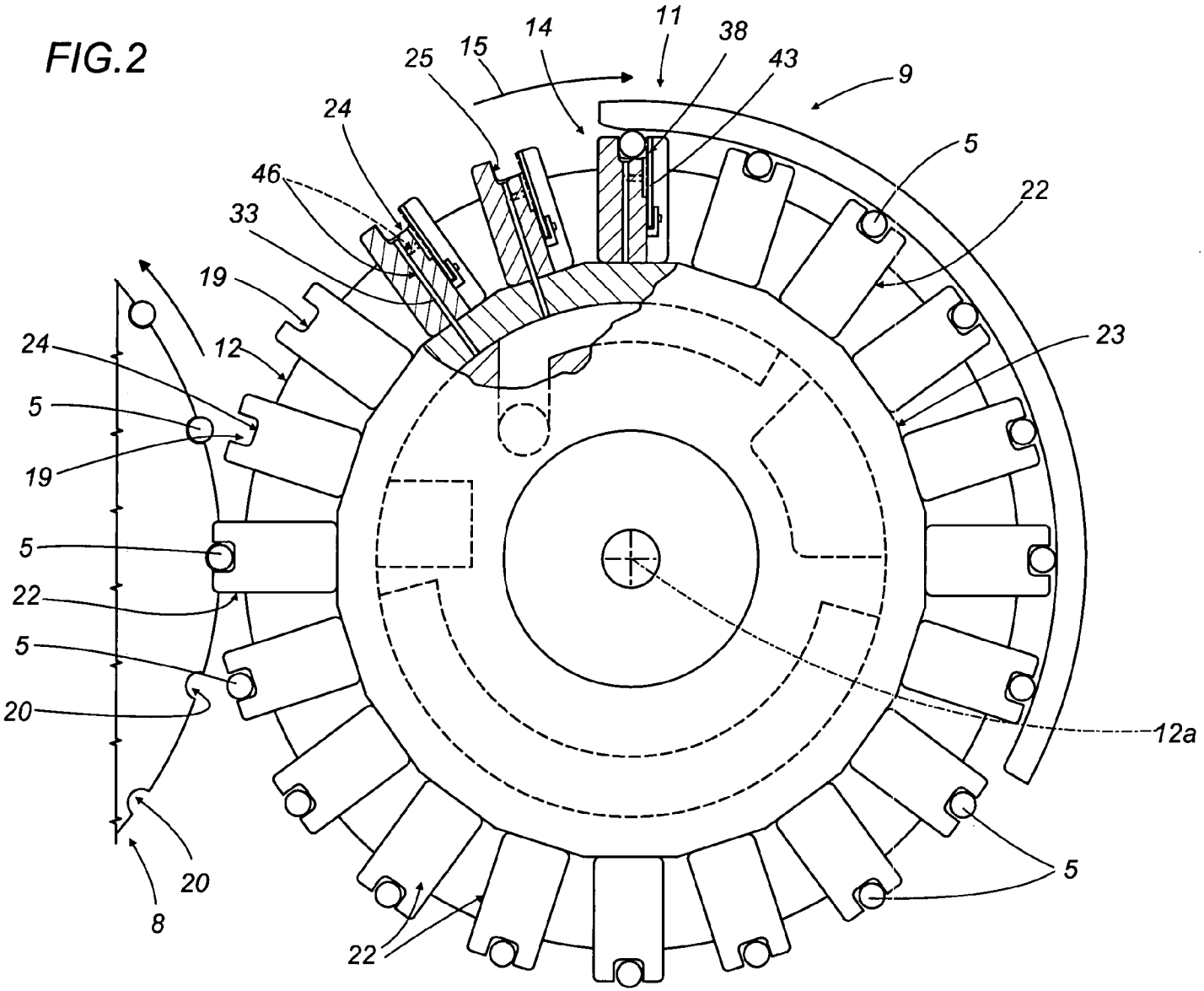
FIG. 2 shows the transfer unit of FIG. 1 in elevation, illustrated partly in section and with certain parts omitted.

Referring to figures 1 and 2 of the accompanying drawings, 1 denotes a cigarette making machine, in its entirety, capable of forming a single cigarette rod; in effect, the drawings show only the outfeed portion of the machine, denoted 1*a*. The machine 1 could also be of a similar type designed to fashion two cigarette rods as in U.S. Pat. No. 4,418,705, to which reference can be made for a full description.

In the example illustrated, which shows a single rod machine 1, the outfeed portion 1*a* comprises a substantially horizontal beam 2 with a longitudinal channel 3 along which a continuous cigarette rod 4 is caused to advance axially at a substantially constant linear velocity. During its passage along the beam 2, the rod 4 is divided up into a relative succession of sticks 5 by a rotating cutter head 6 of conventional embodiment. The cutter head 6 is timed in such a way as to obtain sticks 5 of double length, that is to say, twice the length of the tobacco filled portion forming part of the filter cigarette (not illustrated) in production.

Also shown in FIGS. 1 and 2 is a filter tip attachment 7, of which the drawings illustrate only one portion of an infeed roller 8 (see FIG. 2).

The cigarette maker 1 is connected to the filter tip attachment 7 by way of a transfer unit 9 that comprises transfer means embodied as an impeller device denoted 10 in its entirety, disposed facing toward and adjacent to a runout end of the beam 2, and conveyor means 11 in the form of a conveying roller 12 rotatable tangentially to the infeed roller 8 about an axis disposed parallel to the axis of this same roller.

The impeller device 10, which is conventional in embodiment, receives the cut cigarette sticks 5 as these move along the aforementioned channel 3 in a feed direction denoted 13, advancing toward an entry station 14 where they are taken up onto the conveying roller 12 and thereupon diverted by the selfsame roller in a direction 15 transverse to the direction 13 first mentioned, hence transverse also to their own axes, proceeding clockwise as seen in FIG. 2 toward a station 16 at which they are released to the infeed roller 8 of the filter tip attachment 7.

In the embodiment illustrated by way of example in FIG. 1, the impeller device 10 comprises a power driven roller 17 rotatable about an axis set skew in relation to the feed direction 13 mentioned above and coupled to drive means not indicated in the drawings. The roller 17 rotates substantially tangential to the beam 2 and presents a relative helical groove 18 of which the start is disposed in alignment with the path followed by the sticks 5 advancing along the feed direction 13 and timed to coincide with the approach of the selfsame sticks. The peripheral speed of the roller 17 is at least equal to and preferably greater than the linear velocity of the advancing sticks 5, and the helical pitch of the groove 18 will be such as to invest the intercepted stick 5 with a transverse velocity, in the direction denoted 15, substantially the same as the peripheral speed of the conveying roller 12. In the course of the following specification, the feed direction of the roller 12 is described as the first direction 15, whilst the direction followed by the sticks 5 along the channel 3 of the beam 2 is described as the second direction 13.

The roller 17 could be of the type, for example, disclosed in Italian patent No. 1,282,484, to which reference can be made for a full description.

As illustrated in FIGS. 1 and 2, the conveying roller 12 presents a plurality of channels 19 lying parallel with the second direction 13 and spaced apart uniformly around the peripheral surface.

In operation, with the roller 12 rotating on its axis 12*a* and turning in the first direction 15, the channels 19 are transferred in succession from the entry station 14, where each aligns momentarily with the channel 3 of the beam 2 and receives a respective stick 5 from the impeller device 10, around to the release station 16 where each stick 5 is transferred to a relative groove 20 presented by the infeed roller 8 of the filter tip attachment 7. To facilitate the passage of the sticks 5 into the channels 19, the mouth 21 of the single channel is splayed at the end directed toward the beam 2.

As illustrated in FIGS. 1 to 4, each channel 19 is fashioned from a respective block 22 associated rigidly with the outer cylindrical surface of a drum 23 located within the roller 12 (FIG. 2). More exactly, in the example of FIGS. 3 and 4, each block 22 presents a bottom wall 24 and a first side wall 25 defining the relative channel 19. In the course of entering a relative channel 19, the single cigarette stick 5 enters progressively into contact with two longitudinal areas of the selfsame channel 19, and more exactly with a longitudinal area 26 of the bottom wall 24 and a longitudinal area 27 of the first side wall 25. In this way, each cigarette stick 5 takes up a position in the relative channel 19 (see FIG. 3), making contact with the two longitudinal areas 26 and 27 along two corresponding longitudinal areas 28 and 29 of its outer cylindrical surface, in such a manner as to create at least a first chamber 30 compassed by the portions of the bottom wall 24 and the first side wall 25 lying between the corresponding areas of contact 26 and 27, and the portion of the outer cylindrical surface presented by the cigarette stick 5 lying between the areas of contact 28 and 29 engaging the aforementioned areas 26 and 27.

Figure 6:
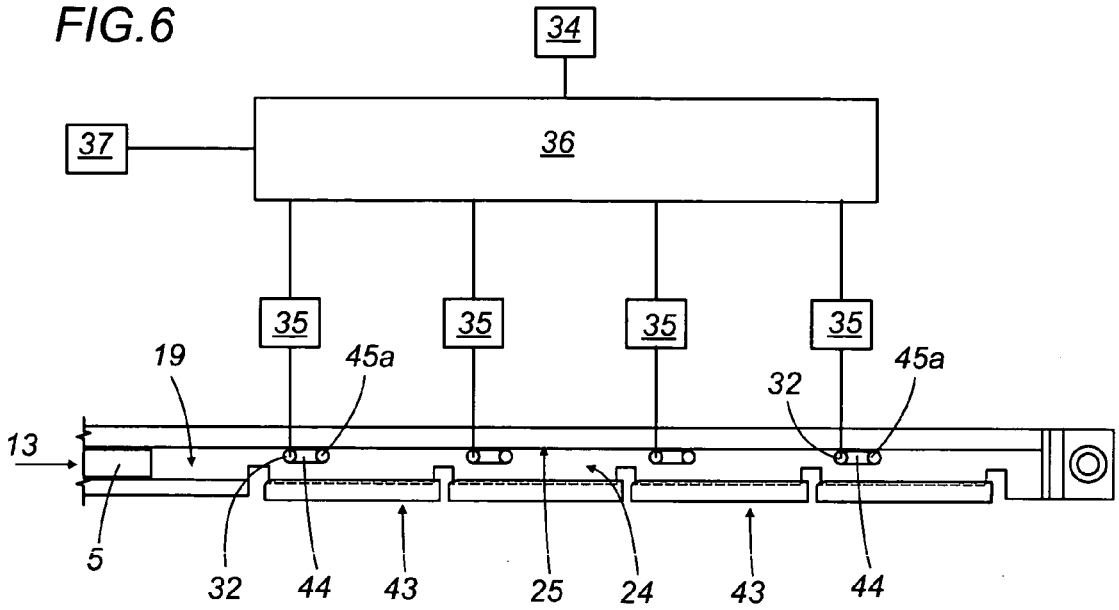
FIG. 6 is a detail of FIG. 1, viewed in plan and illustrated in part as a block diagram.

With reference also to FIG. 6, the chamber 30 is connected by way of first connection means 31 comprising a plurality of holes 32 positioned equidistantly along the channel 19, emerging into the chamber 30 and associated with first ducts 33, to suction means illustrated schematically as a block 34 and capable of generating a partial vacuum in the chamber 30.

The connection between each of the first ducts 33 and the suction means 34 is made by way of solenoid valves 35 forming part of master control means 36 interlocked to a device, illustrated as a block 37, by means of which to monitor the operating speed of the transfer unit 9.

As illustrated particularly in FIGS. 3 to 6, each channel 19 further comprises a plurality of flexible plates 38 associated rigidly with the relative block 22, in number matching the number of holes 32 presented by the bottom wall 24, arranged in succession along the length of the channel and positioned facing the first side wall 25; in the example of FIGS. 1 and 6 each channel 19 presents four holes 32, and therefore four plates 38.

Figure 3:
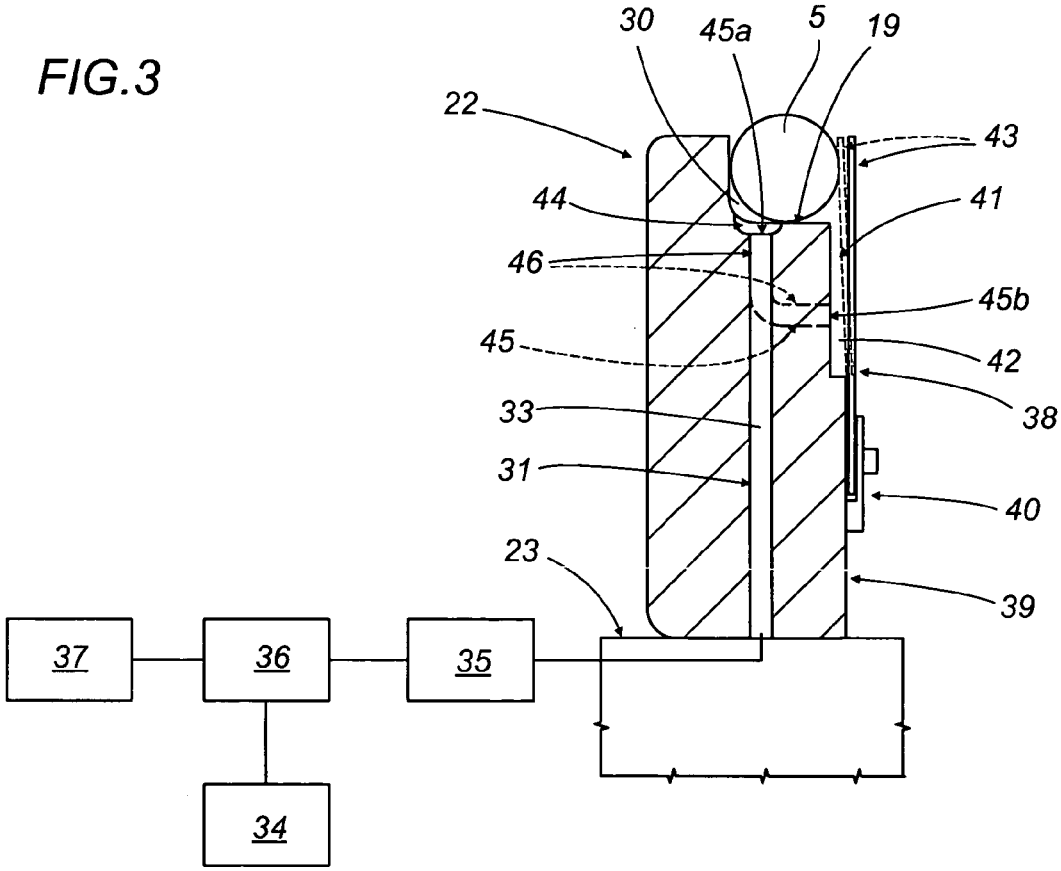
FIGS. 3 and 3*a* show an enlarged detail of the unit in FIG. 1, illustrated in section.
Figure 3A:
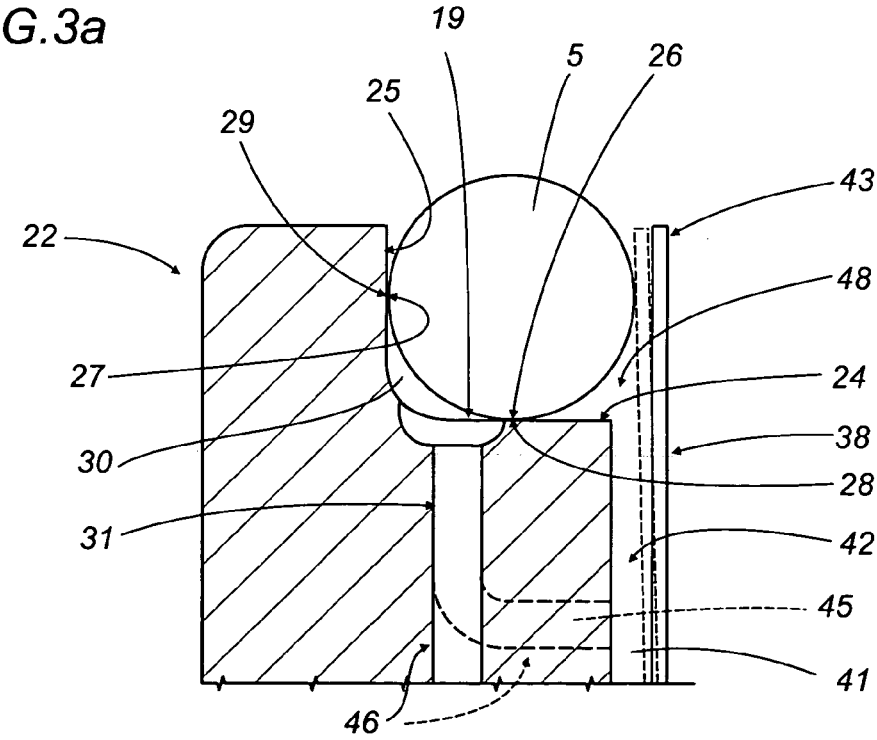
Figure 4:
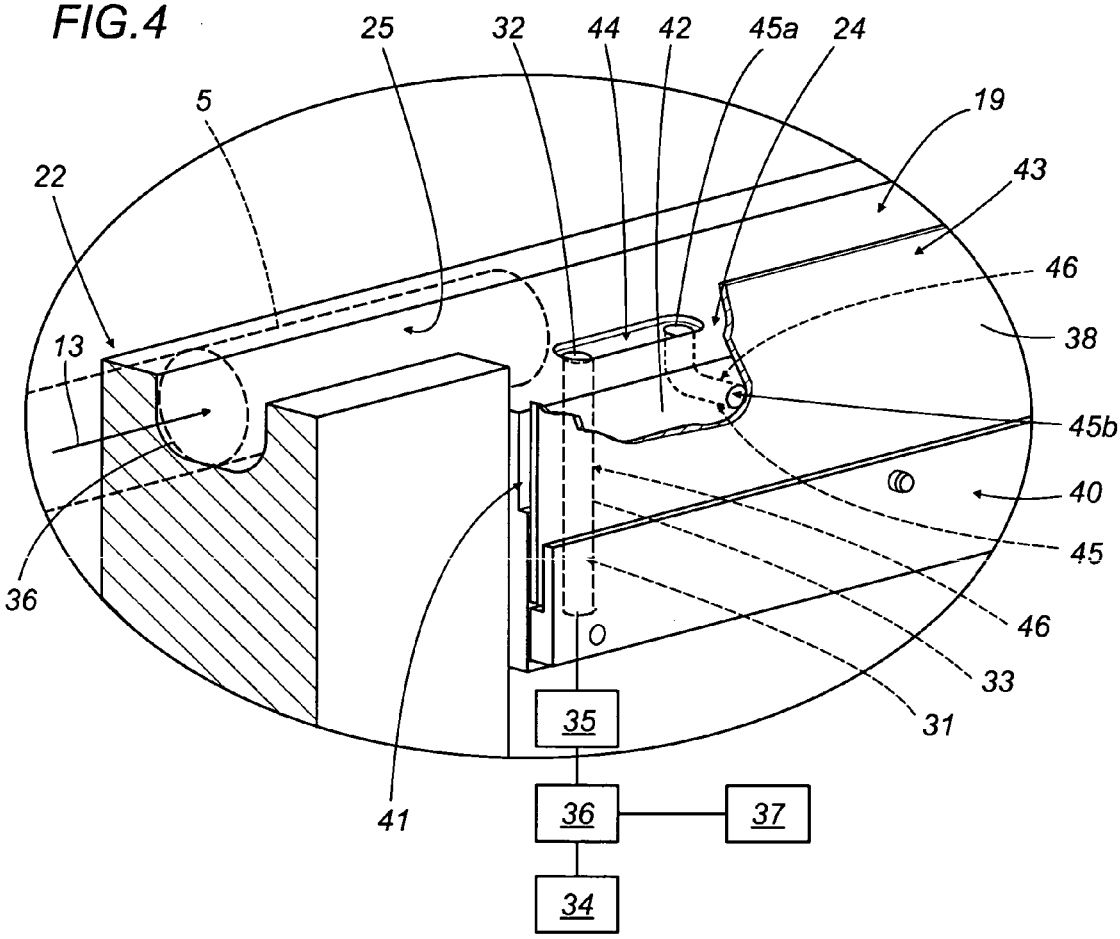
FIG. 4 shows the detail of FIG. 3, viewed in perspective and with certain parts omitted.

More particularly, as discernible from FIGS. 3 and 4, each plate 38 lies in a plane substantially parallel to that occupied by the first side wall 25 of the relative block 22 and is attached by one edge to a face 39 of the selfsame block, positioned radially in relation to the roller 12, adjacent to the bottom wall 24 and parallel to the first side wall 25, and secured with fixing means 40 in such a way that a gap 41 is created between the plate 38 and the face 39, thereby establishing a void 42.

On the side of the free edge, the single flexible plate 38 projects radially through a distance that corresponds substantially to the height of the first side wall 25, in such a way as to create a movable second wall 43 of each channel 19.

Each hole 32 presented by the bottom wall 24 of the channel 19 is set into a cavity 44 that extends a given distance from the relative hole 32 along the selfsame channel, in the second direction 13, and terminates at a point coinciding with the first inlet end 45*a* of a second duct 45 which in turn emerges by way of a second outlet end 45*b* into the gap 41. In practice, the cavity 44 and the second duct 45 combine one with another, and in operating conditions that will be described in due course, to create pneumatic actuator means denoted 46 in their entirety, acting on the movable second side wall 43 in such a manner as will cause it to move between a first position, distanced from the face 39 (shown by the solid line of FIG. 3) and separated from a cigarette stick 5 advancing along the channel 19, and a second position drawn toward the first side wall 25 of the channel 19, in which the plate 38 is flexed (phantom line in FIG. 3) to the point of engaging the outer surface of the cigarette stick 5 and establishing a third area 47 of longitudinal contact with this same surface.

In these operating conditions, the movable second side wall 43 encloses a second chamber 48 connected to the suction means 34 and compassed between the third area of contact 47 and the adjacent area 26 of contact mentioned previously.

With the unit in operation, as discernible from FIGS. 3 to 5*a*, the movement of the cigarette stick 5 along a relative channel 19 has the effect of progressively creating the aforementioned first chamber 30 and at the same time providing a trigger able to activate the pneumatic actuator means 46.

Figure 5:
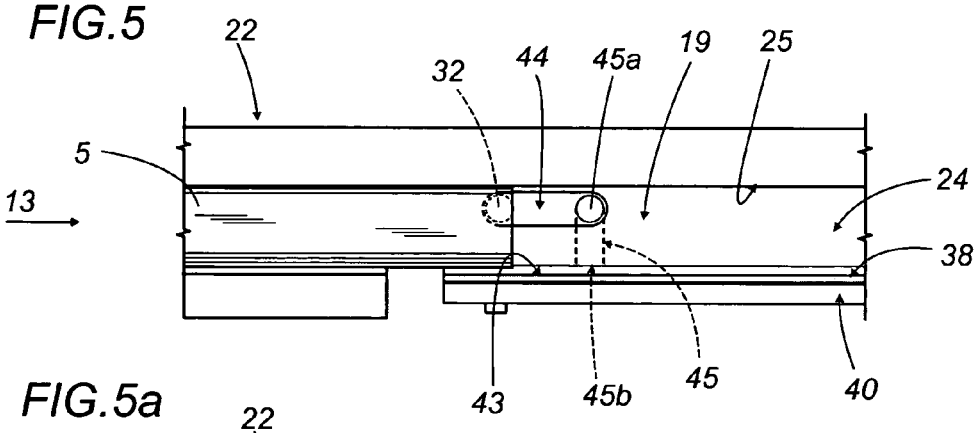
FIGS. 5 and 5*a* show the detail of FIG. 4, viewed in plan and illustrated in two successive operating configurations.
Figure 5A:
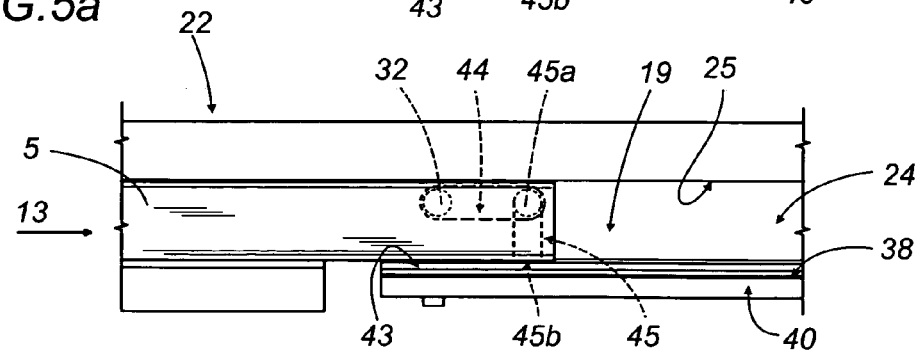

In effect, and as discernible in particular from FIGS. 5 and 5*a*, which illustrate the first of the four holes 32, the interception and concealment of the hole 32 by the cigarette stick 5 (FIG. 5) has the effect of defining a first longitudinal portion of the first chamber 30, whereupon the subsequent concealment of the associated cavity 44 and the inlet end 45*a* of the second duct 45 will close the air circuit that includes the pneumatic actuator means 46 and the first duct 33, causing the gap 41 to communicate with the suction means 34.

With this arrangement, a partial vacuum created in the aforementioned void 42 is sufficient to draw the movable second side wall 43 toward the stick 5, thereby establishing the third area 47 of contact and enclosing the second chamber 48.

As illustrated in FIG. 6, the device 37 serving to monitor the speed of the transfer unit 9 can pilot the operation of the master control means 36 in such a way as to activate a predetermined number of suction holes 32, hence a corresponding number of movable side walls 43, according to the measured speed. Thus, the walls 43 can provide a cushioning action proportionate to the linear velocity of the cigarette stick 5 passing along the channel 19, without the need to adjust the force generated by the suction means 34.

It will be seen that, in contrast to conventional channels or grooves typical of the prior art, the cylindrical surface of the cigarette stick 5 in the example described above is exposed to a partial vacuum and therefore to a more effective cushioning action; moreover, the two longitudinal areas of sliding contact established by the movable second side wall 43 and the first side wall 25 combine to generate an adjustable braking action.

Figure 7:
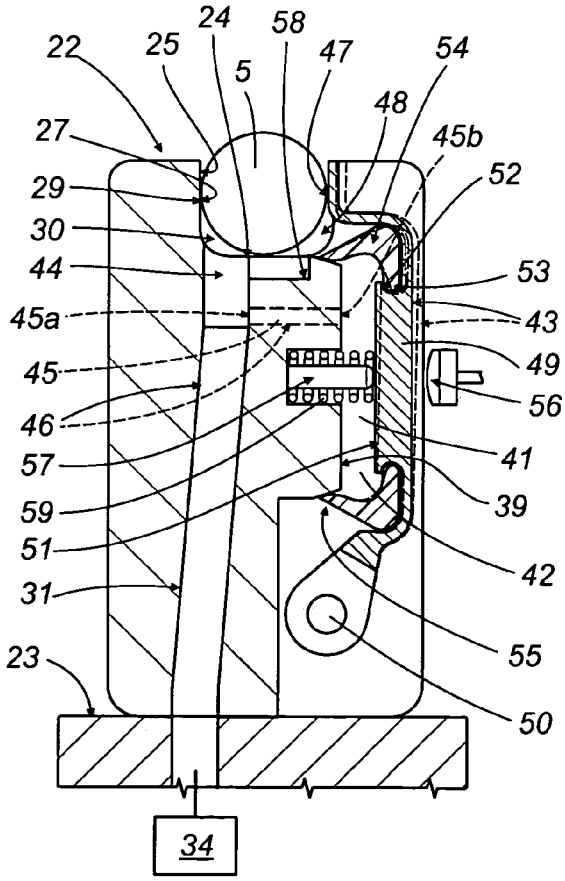
FIG. 7 shows the detail of FIG. 3 enlarged and in a second embodiment, viewed in section.

In the example of FIG. 7, the movable second side wall 43 consists in a plate 49 of which the central portion presents a U shaped cross sectional profile with the concave face directed toward the face 39 of the block 22, to which it is anchored rotatably by way of a relative pivot 50. The inside face 51 of the plate 49 presents an annular seat 52 accommodating a first edge 53 of an annular lip seal, denoted 54, of which a second edge 55 fits slidably over the portion of the block 22 affording the aforementioned face 39. In this instance the gap 41 created between the opposing faces 39 and 51 of the block 22 and the movable wall 43 is enclosed and rendered air-tight by the seal 54.

When the pneumatic actuator means 46 are brought into operation by the advancing cigarette stick 5, as already described with reference to FIGS. 5 and 5*a*, the plate 49 shifts from a first position (see phantom line in FIG. 7) distanced from the face 39 of the block 22, registering against a first stop 56 and separated from the cigarette stick 5 passing along the channel 19, to a second position, nearer to the first side wall 25 of the channel 19 and engaging a second stop 57, in which the top edge of the selfsame plate 49 engages the outer surface of the stick 5 to establish the third area of longitudinal contact 47.

In this operating configuration, the movable side wall 43 combines with the cigarette stick to create the second chamber 48, which is isolated from the void 42 by the seal 54, whereupon a partial vacuum is generated in the selfsame chamber 48 by way of a second cavity 58 transverse to the cavity 44 first mentioned and connected to the suction means 34.

Observing FIG. 7, it will be seen that when the pneumatic actuator means 46 are deactivated, the plate 49 is returned to the aforementioned first position, in contact with the first stop 56, by the action of a spring 59 seated in a socket afforded by the face 39 of the block 22.

Figure 8:
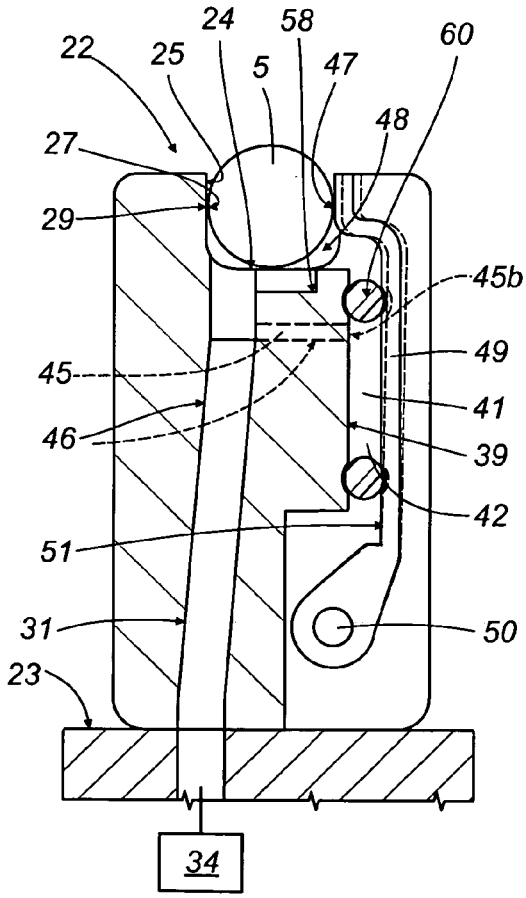
FIG. 8 shows the detail of FIG. 3 enlarged and in a third embodiment, viewed in section.

With reference to the example of FIG. 8, the seal 54 might appear as an annular element 60 of substantially circular section fashioned from a foam or elastic material such as will maintain an air-tight closure while accommodating the changes in position of the movable wall 43.

What is claimed is:

1. A unit for transferring cigarette sticks from a cigarette maker to a filter tip attachment, comprising:

conveyor means, capable of movement in a first feed direction, furnished with channels extending in a second direction and made to advance in the first direction, each channel proportioned to accommodate a respective cigarette stick and including at least two longitudinal areas of progressive contact with corresponding longitudinal areas of the stick in such a way as to create at least one chamber between the cigarette stick and a portion of the channel compassed between the longitudinal areas of progressive contact;

an entry station at which a single cigarette stick is admitted to each channel as the channels are directed through the station by the conveyor means;

transfer means facing the entry station, by which the cigarette sticks are advanced along the second direction and into the channels;

first connection means by which the chamber is connected to suction means;

each channel including a third longitudinal area, extending along at least a portion of its length and capable of engaging in contact with a corresponding third longitudinal area of the cigarette stick admitted by way of the entry station to form a third longitudinal area of contact, the third longitudinal area of the channel positioned on an opposite side of the cigarette stick from, and substantially facing, one of the at least two longitudinal areas of progressive contact of the channel;

the third longitudinal area of the channel being created by at least one movable wall capable of motion, induced by pneumatic actuator means, between respective limit positions of 1) engagement with the cigarette stick along the third longitudinal area of the channel and 2) disengagement from the cigarette stick, the third longitudinal area of the channel being distanced from the cigarette stick.

2. A unit as in claim 1, wherein the first connection means comprises at least one hole emerging into the chamber and associated with a respective first duct connected to the suction means.

3. A unit as in claim 2, wherein the first connection means comprises a plurality of holes arranged along each channel, each hole associated with a respective duct connected to the suction means.

4. A unit as in claim 3, wherein the first connection means comprises valve means associated with each duct and interlocked to respective master control means.

5. A unit as in claim 4, wherein the master control means are interlocked to a device for monitoring an operating speed of the unit for transferring.

6. A unit as in claim 3, wherein the movable wall is designed, when occupying the limit position of engagement with the cigarette stick along the third longitudinal area of contact, to establish a second chamber compassed between the third longitudinal area of contact and one of the at least two longitudinal areas of progressive contact immediately adjacent, internally of which a partial vacuum is created by the pneumatic actuator means.

7. A unit as in claim 6, wherein each channel is formed from a respective block of the conveyor means and comprises at least one bottom wall and a first side wall establishing the at least two longitudinal areas of progressive contact, also a second side wall positioned opposite the first side wall and provided by the at least one movable wall, and second ducts forming part of the pneumatic, actuator means and connecting with the suction means.

8. A unit as in claim 7, wherein each of the second ducts presents a first end communicating way of a cavity with the first duct of one of the holes, the cavity being formed in the bottom wall and extending from the hole through a predetermined distance along the second direction, and a second end by way of which the second duct emerges into a gap compassed between the block and the at least one movable wall.

9. A unit as in claim 8, wherein the pneumatic actuator means are activated by the cigarette stick in the course of its passage over the cavity, in such a manner as to generate a partial vacuum in the gap compassed between the block and the at least one movable wall and consequently bring the at least one movable wall into the position of engagement with the stick along the third longitudinal area of contact.

10. A unit as in claim 9, wherein each channel presents a plurality of movable walls equal in number to the number of the holes.

11. A unit as in claim 10, wherein the movable walls can be activated selectively through the agency of the valve means interlocked to the respective master control means, of which the operation is piloted by the device monitoring the operating speed of the unit for transferring.

12. A unit as in claim 11, wherein each movable wall is a plate of flexible material.

13. A unit as in claim 8, wherein a gap compassed between the at least one movable wall and the face of the block is enclosed by a seal interposed between the at least one movable wall and the face of the block.

14. A unit as in claim 13, wherein the second chamber is isolated from the gap by the seal and connected to the pneumatic actuator means by way of a second cavity disposed transversely to the cavity extending along the second direction.

15. A unit as in claim 13, wherein the limit positions assumed by the movable walls are determined by respective stops, and the position of disengagement from the cigarette stick is maintained by spring means.

16. A unit for transferring cigarette stick from a cigarette maker to a filter tip attachment, comprising:

conveyor means, capable of movement in a first feed direction, furnished with channels extending in a second direction and made to advance in the first direction, each channel proportioned to accommodate a respective cigarette stick and presenting at least two longitudinal areas of progressive contact with corresponding longitudinal areas of the cigarette stick in such a way as to create at least one chamber between the cigarette stick and a portion of the channel compassed between the at least two longitudinal areas of progressive contact;

an entry station at which a single cigarette stick is admitted to each channel as the channels are directed through the station by the conveying means;

transfer means facing the entry station, by which the cigarette sticks are advanced along the second direction and into the channels;

first connection means by which the chamber is connected to suction means;

wherein the first connection means comprises a plurality of holes arranged along each channel, each associated with a respective duct connected to the suction means and each channel presenting a plurality of flexible plates equal in number to the number of the holes, each flexible plate engageable with a cigarette stick alone a third longitudinal area of contact.

* * * * *